United States Patent [19]

Thomas

[11] Patent Number: 4,635,718

[45] Date of Patent: Jan. 13, 1987

[54] CONTINUOUS OBSTRUCTION MONITOR FOR WELL LOGGING TOOLS

[76] Inventor: Ralph R. Thomas, SR 2, Box 6240, Chugiak, AK. 99567

[21] Appl. No.: 752,470

[22] Filed: Jul. 5, 1985

[51] Int. Cl.[4] ..... E21B 23/00; E21B 47/00

[52] U.S. Cl. ..... 166/250; 166/67; 166/113; 166/237; 166/381

[58] Field of Search ..... 166/250, 255, 381, 113, 166/102, 67, 333, 242, 238, 237; 73/152

[56] References Cited

U.S. PATENT DOCUMENTS

| | | | |
|---|---|---|---|
| 3,965,978 | 6/1976 | Conley et al. | 166/113 |
| 4,168,747 | 9/1979 | Youmans | 166/250 |
| 4,184,545 | 1/1980 | Claycomb | 166/113 |
| 4,349,072 | 9/1982 | Escaron et al. | 166/250 |
| 4,359,900 | 11/1982 | Garney | 73/151 |
| 4,488,597 | 12/1984 | Hoppe et al. | 166/250 |

*Primary Examiner*—Stephen J. Novosad
*Assistant Examiner*—Hoang C. Dang
*Attorney, Agent, or Firm*—Neal J. Mosely

[57] ABSTRACT

A continuous obstruction monitor for well logging drill strings including a well logging instrument at the forward end thereof transports the logging instrument through an earth borehole while continuously monitoring for obstructions. An outer tubular housing is connected at its upper end to the drill string and a piston therein is connected to the upper portion of the logging instrument. The housing has a variable volume greater than the volume of an equal length of the drill string. The piston is electrically connected to the surface. A latch retains the piston in the lower portion of the housing, and releases it when an obstruction is encountered. The outer housing moves downward relative to the piston to a point where a sealing surface at the mid portion of the housing shuts off fluid flow below the piston and causing the drilling fluid to rise within drill string to be detected at the surface. Further movement of the housing positions the piston in the upper portion thereof to open a fluid flow path through the drill string bypassing the piston to exit the housing to circulate drilling fluid close to the borehole obstruction. In its uppermost position, the piston seals the drill string preventing a through pipe blowout.

42 Claims, 14 Drawing Figures

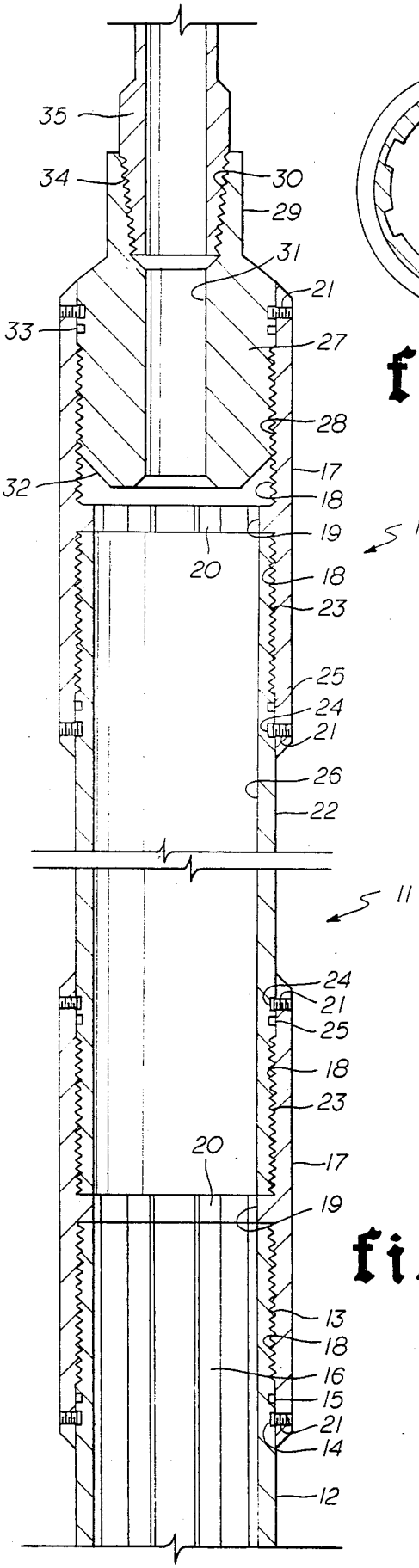
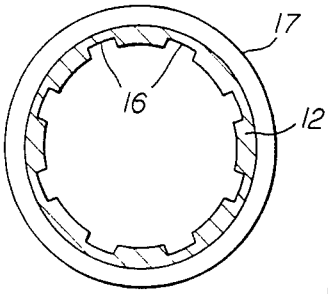
fig. 1d
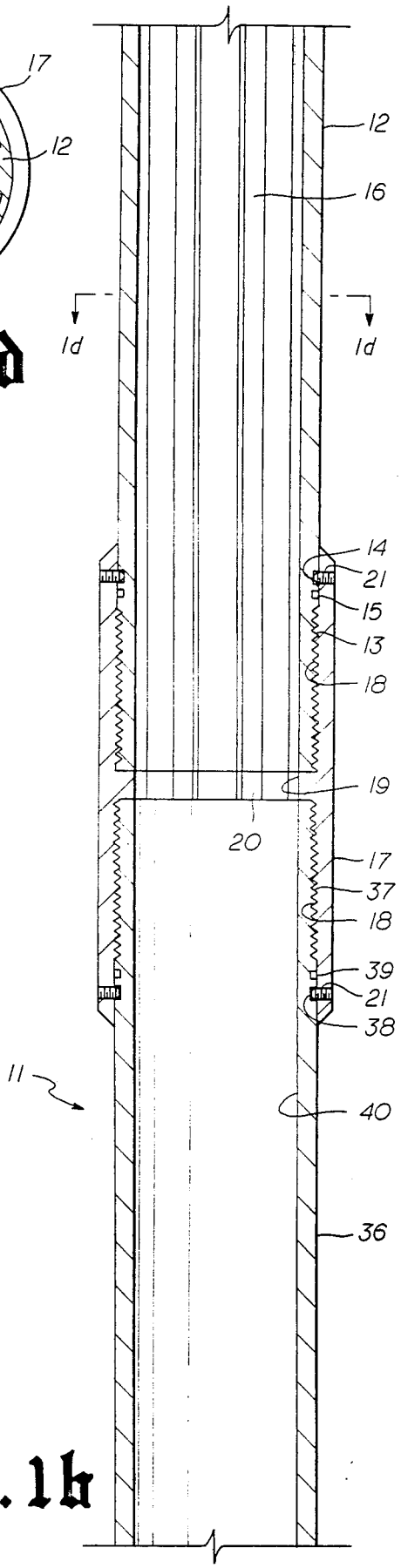
fig. 1a
fig. 1b

CONTINUOUS OBSTRUCTION MONITOR FOR WELL LOGGING TOOLS

BACKGROUND OF THE INVENTION

1. Field of the Invention

This invention relates generally to well logging tools, and more particularly to a continuous obstruction monitor installed between the drill string and the logging tool which utilizes drilling fluid to indicate when the logging tool has encountered an obstruction and allows for transporting and setting of the logging tool, circulation through the monitor housing, and reciprocation of the drill pipe while continuously monitoring for borehole obstructions.

2. Brief Description of the Prior Art

Systems which transport well logging tools on the drill string are known in the art. Conventional systems incorporate a cable and wet connect transport assembly or locomotive which is forced down the borehole by mud pressure within the drill string to make the electrical connection to the logging tool. A side door sub in the drill string allows the cable to be run along the outside of the pipe for some distance downhole. The side door sub permits the cable to enter the pipe and seals it to prevent loss of drilling mud pressure. In the logging operation, with the tool at the total depth and electrical connection from the logging tool to the surface, drill pipe is removed one joint at a time while the cable is spooled in at the same rate. The present invention is used in conjunction with conventional wet connect cable transport assemblies or locomotives, side door subs, logging tools, and utilizes state of the art logging procedures.

The most common method of transporting the logging tool is to mount the logging tool on the drill string enclosed in a protective sleeve with openings to allow sensors to contact the borehole from within the sleeve. Distorted data curves sometimes occur due to the proximity and interference from the sleeve. The only indication of an obstruction in this type of system is when the drill string stops which often causes damage to the logging tool or the sleeve. Attempts at circulating the obstruction away using the openings in the sleeve is limited because the circulation is above the obstruction.

Another common method of transporting the logging tool is to mount the logging tool on the drill pipe with a shock absorbing device to protect the tool while monitoring obstructions electrically with a tension device downhole. This eliminates sleeve interference, but because of side door sub cable limitations, satisfactory electrical connection is not always possible. A well with a 2,500 foot kick out depth (point at which bore begins to deviate from vertical) and 12,500 feet in total depth would leave 10,000 feet of hole to traverse without a weight indicator. If an obstruction is encountered, circulation can be made at the top of the tool string but not at the obstruction location at the bottom of the string.

Another transport method is one which utilizes protective sleeves mounted on the drill string with the logging tool retained by a complex latch mechanism. This system uses a two piece wet connect cable transport assembly which separates after being latched to the logging tool. Releasing the latch mechanism allows the logging tool to be lowered from the protective sleeve for the logging operation. The complexity of the latching system makes it prone to numerous failures. Because most of the drilling fluid escapes at the latch assembly, only a small amount of circulating fluid is directed to the obstruction. The logging tool may also be blocked in the sleeve by debris from the obstruction building up in the sleeve.

There are several patents which disclose apparatus for monitoring or measuring pressure while drilling and supporting sensing devices in well logging tools.

Conley et al, U.S. Pat. No. 3,965,978 discloses a subsurface transient pressure indicator suitable for for shutting off fluid flow through tubing at a subsurface location in a completed well containing a packer in the tubing-casing string annulus. The device has a seating nipple forming a part of the tubing string positioned at the downhole location at which it is desired to shut off fluid flow through the tubing. The nipple has an upwardly facing shoulder, and a main plug member having a downwardly facing seating area is adapted to seat in the seating nipple. The main plug member is connected to the surface of the well by a wireline or cable. A port extends through the main plug below the point of seal with the nipple to a second seating area and a second port from the second seating area to a point above the point of seal. A pressure measuring means communicates with the tubing space below the point of seal. A relief plug is adapted to seat in the second seating area of the main plug. Pressure is equalized in the tubing string above and below the device by pulling upwardly on the wireline to pull the relief plug body away from the second seating area.

This device measures transient pressure in a completed well and is quite different than the present invention which is a transport system for well logging tools which is transported on drill pipe and functions as a continuous obstruction monitor independent of cable connections.

Claycomb, U.S. Pat. No. 4,184,545 discloses a measuring and transmitting apparatus comprising an elongate tubular member functioning as a drill collar and adapted to to be placed in a drill string while drilling a well. The apparatus utilizes a mud driven motor, while the mud flows therethrough functioning as a drill collar and out the bottom. The motor creates electric power which is used to operate transducers forming measurements which are encoded. The encoding portion of the equipment utilizes an oil reservoir, a mud driven pump, a valve which dumps the oil back to the reservoir if there is no signal and which otherwise delivers it to a spool valve which drives a modulated signal generator. The signal generator modulated the back pressure in the mud flow by restricting the mud flow, thereby forming a signal which is sensed in the mud flow path. This device modulates mud flow through it and must have a surface mud pump attached to function.

Garney, U.S. Pat. No. 4,359,900 discloses an elongated well logging instrument having a lever latch and positioning mechanism attached to a carriage and a snorkel and barrel assembly. One end of a pressure sensing device is mounted on the carriage and the snorkel is affixed to the opposite end. The latch and positioning mechanism allows the assembly to be moved until the snorkel enters the barrel and retains it in place. The mechanism is then secured in place. The mechanism contains an indicator which is visible if the mechanism is not in a position to be secured. Electrical signals are passed from the sensing device, through the snorkel to an electrical connector at the end of the barrel and through a cable to the surface.

Peppers et al, U.S. Pat. No. 4,483,394 discloses a hydraulic power unit for for a downhole instrument of a measurement while drilling system. The hydraulic unit is enclosed within a drill collar that is connected to a drill string of a rotary drilling rig. An outer body sleeve is rigidly mounted in the instrument drill collar, and a fixed inner sleeve is connected to the outer body sleeve in a concentric relation. A longitudinally movable plunger assembly is supported between the outer sleeve and inner sleeve and movable in a telescopic fashion between an extended position and a retracted position to provide hydraulic power fluid for the operation of hydraulically powered circuits of the instrument.

The prior art in general, and these patents in particular, do not disclose the present invention of a continuous obstruction monitor installed between the drill string and the logging tool which utilizes drilling fluid to indicate when the logging tool has encountered an obstruction and allows for transporting and setting of the logging tool, circulation through the monitor housing, and reciprocation of the drill pipe while continuously monitoring for borehole obstructions.

SUMMARY OF THE INVENTION

It is therefore one object of the present invention to provide a continuous obstruction monitor for well logging tools which may be used in conjunction with conventional wet connect cable transport assemblies, side door subs, and utilizes state of the art logging procedures.

Another object of this invention is to provide a continuous obstruction monitor for well logging tools which utilizes the displacement of drilling fluid to indicate when the logging tool has encountered an obstruction and requires no cable or pump connections to accomplish this end.

Another object of this invention is to provide a continuous obstruction monitor for well logging tools which allows the logging tool to retract within an outer housing when an obstruction is encountered and allows drilling fluid to be circulated directly at the location of the obstruction.

Another object of this invention is to provide a continuous obstruction monitor which allows for transporting and setting of the logging tool, circulation through the monitor housing, and reciprocation of the drill pipe while continuously monitoring for borehole obstructions.

Another object of this invention is to provide a continuous obstruction monitor which is simple in construction and operation, economical to manufacture, reliable, and rugged and durable in use.

Other objects of the invention will become apparent from time to time throughout the specification and claims as hereinafter related.

The above noted objects and other objects of the invention are accomplished by a continuous obstruction monitor for well logging drill strings including a well logging instrument at the forward end thereof which transports the logging instrument through an earth borehole while continuously monitoring for obstructions. An outer tubular housing is connected at its upper end to the drill string and a piston therein is connected to the upper portion of the logging instrument. The housing has a variable volume greater than the volume of an equal length of the drill string. The piston is electrically connected to the surface. A latch retains the piston in the lower portion of the housing, and releases it when an obstruction is encountered. The outer housing moves downward relative to the piston to a point where a sealing surface at the mid portion of the housing shuts off fluid flow below the piston and causing the drilling fluid to rise within drill string to be detected at the surface. Further movement of the housing positions the piston in the upper portion thereof to open a fluid flow path through the drill string bypassing the piston to exit the housing to circulate drilling fluid close to the borehole obstruction. In its uppermost position, the piston seals the drill string preventing a through pipe blowout.

DESCRIPTION OF THE PREFERRED EMBODIMENT

Figure 1R:
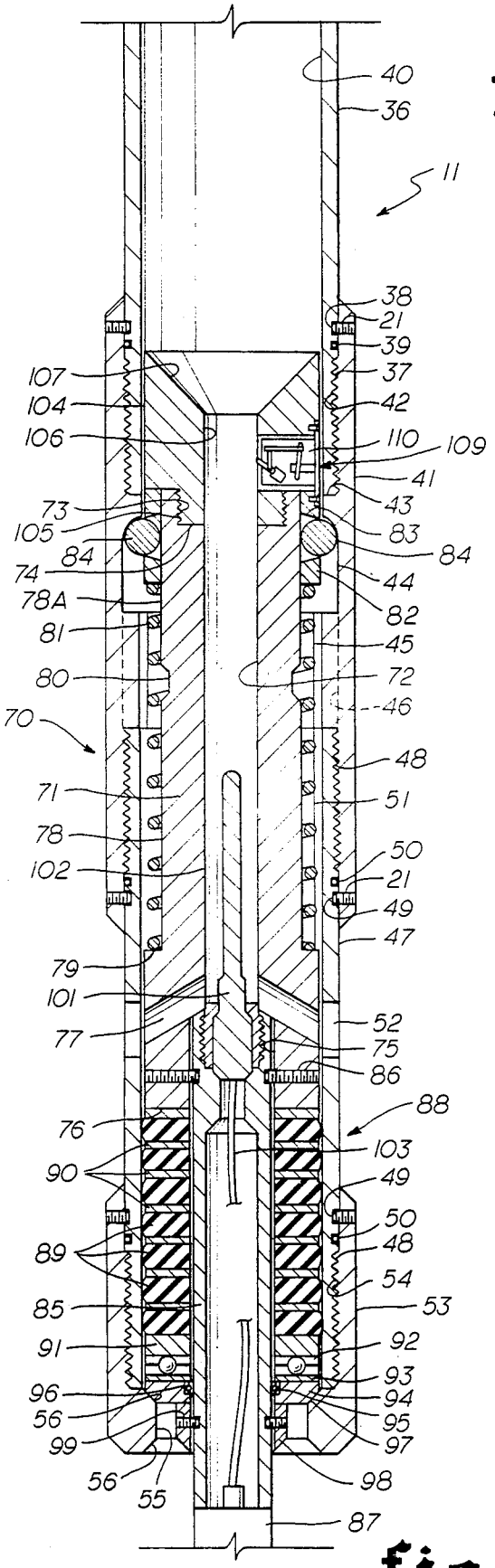
FIGS. 1*a*, 1*b*, and 1*c* taken together constitute a longitudinal section showing the details of a preferred continuous obstruction monitor for well logging tools.
FIG. 1*d* is a horizontal cross section taken along line 1*d*—1*d* of FIG. 1*b* showing the longitudinal slots of the bypass sleeves of the tool.
Figure 6:
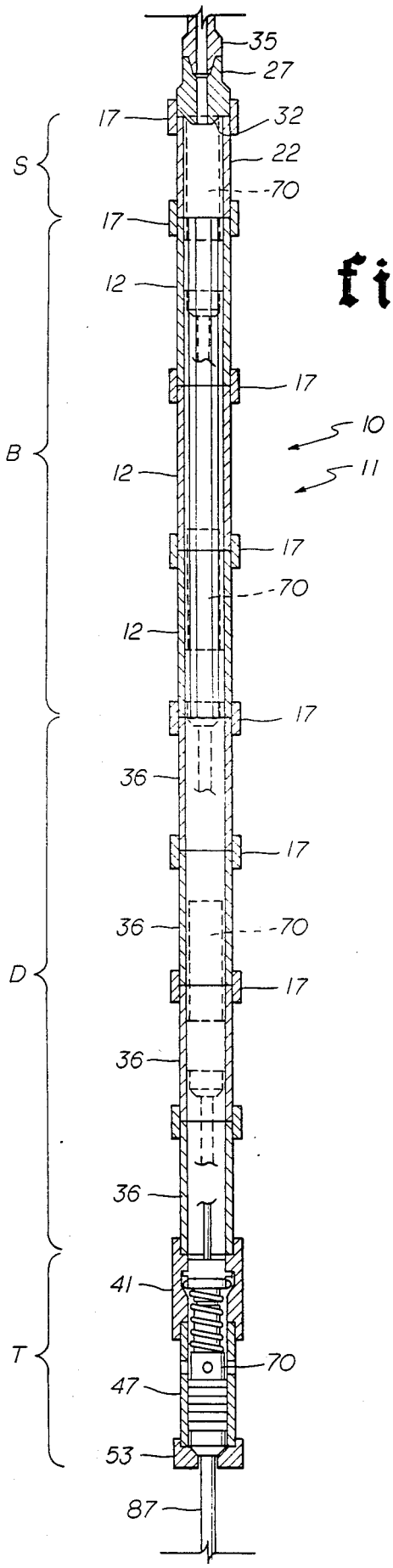
FIG. 6 is a schematic elevation of the assembled continuous obstruction monitor with various piston positions shown in dotted line.

Referring to the drawings by numerals of reference, there is shown in FIGS. 1*a*–1*c* and schematically in FIG. 6, a preferred continuous obstruction monitor assembly 10, hereinafter referred to as "COM". An outer housing 11 comprises a series of bypass sleeves 12 each of which has external threads 13 at each end and a circumferential groove 14 disposed on the exterior surface inwardly of the threads. Annular seals 15 are provided on the sleeves 12 at each end intermediate the threads 13 and grooves 14 for sealing the threaded connection. Bypass sleeves 12 have a plurality of circumferentially spaced longitudinal slots 16 formed on the interior surface, as shown in FIG. 1*d*.

The bypas sleeves 12 are connected together at each end by a series of collars 17 having internal threads 18 and a central reduced internal diameter forming a shoulder 19 with longitudinal slots 20 corresponding to the sleeve slots 16. The collars 17 are threadedly hand tightened onto the sleeves 12 and with the slots 16 and 20 in longitudinal axial alignment are locked onto the sleeves by set screws 21 which are received within the grooves 14 of the sleeves 12.

A blowout prevention sleeve 22 hereinafter "BOP" sleeve is connected at its lower end to the uppermost bypass sleeve 12. The BOP sleeve 22 has external threads 23 at each end and a circumferential groove 24 disposed on the exterior surface inwardly of the threads. Annular seals 25 on the exterior surface of the BOP sleeve 22 at each end intermediate the threads 23 and grooves 24 seal the threaded connection. The BOP sleeve 22 is shorter in length than bypass sleeves 12 and has a smooth internal diameter 26. Another collar 17 is installed and locked (as previously described) on the upper threaded end of the BOP sleeve 22.

A crossover sub 27 having an externally threaded lower portion 28 is threaded and locked (as previously described) into the upper portion of the upper collar 17. The upper portion 29 of the crossover sub 27 has a smaller O.D. than the lower portion 28 and has internal threads 30 extending inwardly from the top to a smaller I.D. bore 31. The bottom of sub 27 is tapered inwardly downward forming a convex conical sealing surface 32. An annular seal 33 fits the outer circumference of the lower portion 28 above the threads. The lower threaded portion 34 of a conventional drill pipe 35 is secured in the threads 30.

The lower intermediate portion of outer housing 11 of the COM assembly 10 comprises a series of sealing sleeves 36 installed beneath the bypass sleeves 12. Each sealing sleeve 36 has external threads 37 at each end and a circumferential groove 38 on the exterior surface inwardly of the threads. Annular seals 39 on the sealing sleeves 36 at each end intermediate the threads 37 and grooves 38 seal the threaded connection. The internal surface 40 of each sealing sleeve 36 is smooth and substantially the same I.D. as the bypass sleeves 12. The sealing sleeves 36 are connected together at each end by a series of collars 17 threadedly hand tightened onto the sleeves 36 and locked by set screws 21 fitting the grooves 38.

A latch collar 41 threadedly on the bottom portion of the lower sealing sleeve 36 has internal threads 42 at each end, a reduced diameter bore defining a shoulder 43 immediately below the top internal threads, an internal annular groove 44 immediately below the shoulder 43, and a plurality of circumferentially spaced longitudinal slots 45 formed on the interior surface below the annular groove 44. Shoulder 43 has circumferentially spaced longitudinal slots 46 corresponding to the lower slots 45. the latch collar 41 is threadedly hand tightened onto the lowermost sealing sleeve 36 and locked onto the sleeve by set screws 21 which are received within the grooves 38.

A transport sleeve 47 with threads 48 at each end and a groove 49 inward of the threads is installed beneath the latch collar 41. Annular seals 50 on the sleeve 47 at each end intermediate the threads 48 and grooves 49 seal the threaded connection. The upper external threads 48 are secured in the lower internal threads 42 of the latch collar 41.

The transport sleeve 47 is hand tightened into the latch collar 41 and locked by set screws 21 which fit the grooves 49. A plurality of circumferentially spaced longitudinal slots 51 on the interior surface of the transport sleeve 47 and a plurality of circumferentially spaced apertures 52 extend through the side wall of the transport sleeve for passage of drilling mud from the interior of the sleeve into the borehole.

A retaining ring 53 with internal threads 54 is installed on the lower external threads 48 of the transport sleeve 47. The internal threads 54 of the retaining ring 53 extend inwardly from the top to a reduced diameter bore 55 defining an inwardly and downwardly tapered shoulder 56.

Figure 2:
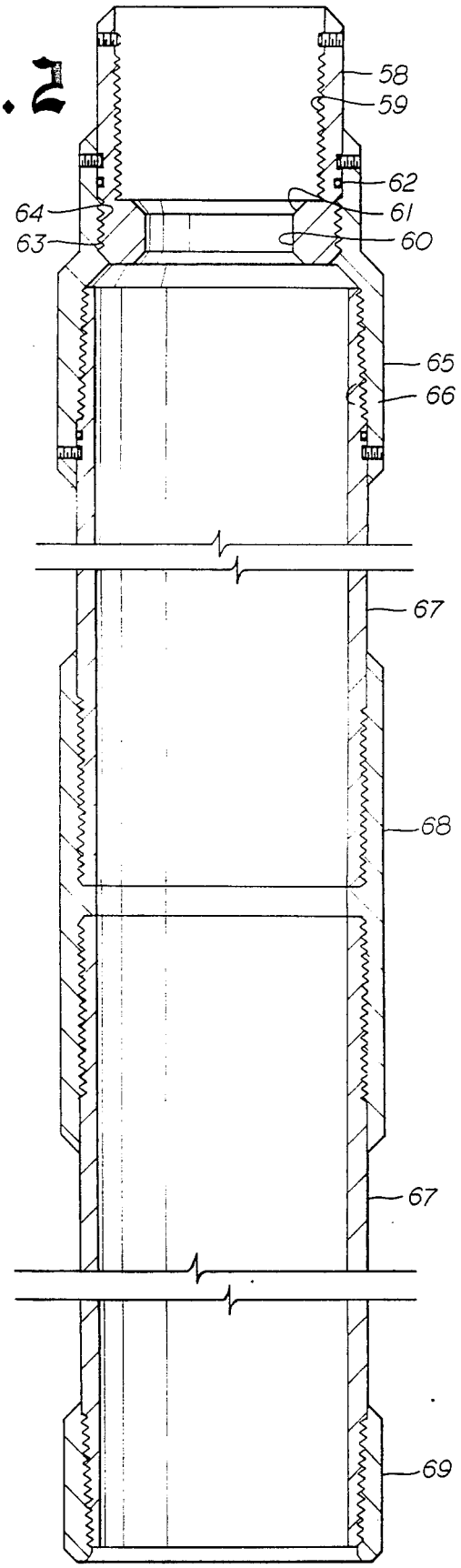
FIG. 2 is a longitudinal cross section showing the details of a modified lower portion of the outer housing of the continuous obstruction monitor for well logging tools.
Figure 7:
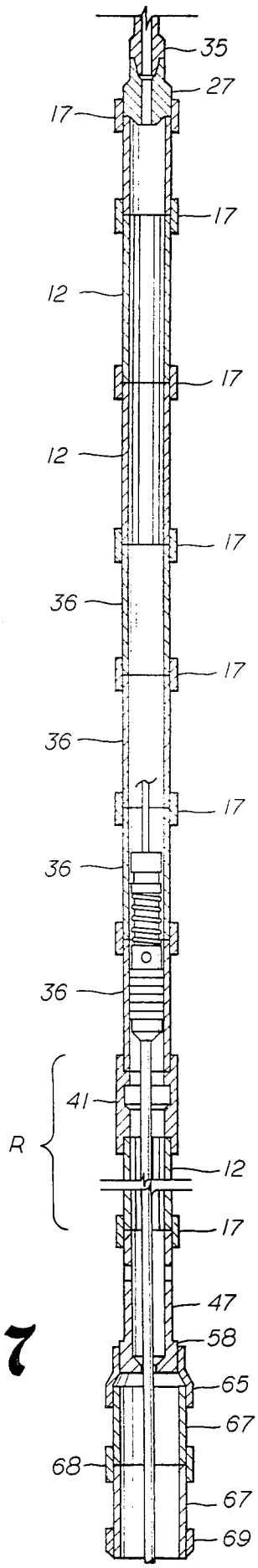
FIG. 7 is a schematic elevation of the assembled continuous obstruction monitor having a modified lower portion.

Optionally, as shown schematically in FIG. 7, the housing 11 may be adapted to be connected to other sizes of pipe or casing and for use with large diameter logging instruments. As shown in FIG. 2, a modified retaining ring 58 with internal threads 59 is installed on the lower threads 48 of the transport sleeve 47. The internal threads 59 of the retaining ring 58 extend inwardly from the top and terminate in a reduced diameter bore 60 to define an inwardly and downwardly tapered shoulder 61.

The exterior bottom portion of the retaining ring 58 has an annular seal 62 and exterior threads 63 which receive the upper interior threads 64 of a crossover adapter coller 65. In the example illustrated, the bottom portion of the modified retaining ring 58 has tapered casing threads 66, allowing conventional sections of casing 67 connected by conventional casing collars 68 to be installed below the transport sleeve 47. A thread protector ring 69 may be installed on the threaded bottom end of the lowermost section of casing to protect the threads.

A floating piston 70 is reciprocally contained within the outer housing 11. The piston 70 has a cylindrical body 71 with a central bore 72 and internal threads 73 in the upper portion with a shoulder 74 therebetween. The interior bottom portion has a counterbore 75 extending from the flat bottom surface 76. Circulation ports 77 extend angularly from the exterior of the piston body 71 to the central bore 72 for circulating drilling mud through the piston to the outside.

The piston body 71 has a reduced O.D. portion 78 with a shoulder 79 above the ports 77 and a circumferential groove 80 near the upper end. The upper portion of the piston body 71 has a reduced O.D. forming a camming surface 78A between the upper reduced diameter and the groove 80. A compression spring 81 surrounds the reduced O.D. portion 78 and abuts the shoulder 79. A cylindrical ring 82 is supported on the top of the compression spring 81. A series of spaced tapered apertures 83 extend through the side wall of the ring 82.

A series of ball members 84 are movably contained in the apertures 83 between the camming surface 78A and the internal diameter of the ring 82. The diameter of the ball members is greater than the slots 45 of the latch collar 41 so that they are prevented from entering the slots. The tapered apertures 83 prevent the ball members 84 from falling out of the ring while allowing them to rotate and travel radially inward and outward following the profile of the camming surface 78A and groove 80 as the ring 82 travels along the longitudinal axis of the piston body 71.

The compression spring 81 is of sufficient strength to require 2,500 pounds of force to move the piston from the latched position with the ball members 84 in groove 44 of the latch collar 41 to the unlatched position with the ball members retracted into the groove 80 of the piston 70.

The upper end of a cylindrical wet connector housing 85 is received within the counterbore 75 and locked into the bottom of the piston body 71 below the circulation ports 77 by set screws 86. The lower portion of the wet connector housing 85 extends outwardly from the piston body 71. The lower end of the wet connector housing 85 is connected by conventional connection means to the top portion of a conventional well logging tool 87.

A seal assembly 88 has resilient seal members 89 interposed between a series of thin spacer discs 90 and surrounds the lower portion of the wet connector housing 85. A bottom spacer disc 91 is disposed at the bottom of the lowermost seal member 89. Sufficient clearance is provided between the circumference of the housing 85 and the internal diameter of the seal members 89 and the spacer discs 90 to allow the seal assembly 88 to travel longitudinally on the housing 85.

A thrust bearing 92 is installed on the housing 85 and a thin retaining disc 93 is installed therebelow. A retaining plate 94 is installed on the housing 85 below the retaining disc 93 and carries a rotary bearing 95 within a counterbore 96 at its upper end. The bottom surface 97 of the retaining plate 94 is beveled at an angle corresponding to the tapered shoulder 56 of the retaining ring 53 to be supported thereon.

A cylindrical stop sleeve 98 is installed on the housing 85 below the retaining plate 94 and secured thereon by set screws 99 to limit downward travel of the seal assembly 88 and retaining plate 94. The lower end of the wet connector housing 85 below the stop sleeve 98 is of sufficient diameter to freely pass through the bore 55 of the retaining ring 53.

The male element of a wet connector 101 is secured by conventional means within the upper portion of housing 85 and the connecting portion 102 extends upwardly a distance from the housing 85 centrally within the piston bore 72. The bottom of the male element is connected by wire leads 103 to the logging tool 87 in a conventional manner.

A guide cone 104 having a reduced diameter bottom portion with external threads 105 is threadedly received and secured in the threaded top portion of the piston body 71. The O.D. of the top portion of the guide cone 104 is sized to clear the I.D. of the sleeves and collars of the outer housing 11. The top surface of the guide cone 104 tapers angularly downward and inward to a central bore 106 of the same I.D. as the bore 72 of piston body 71. The tapered top surface of the guide cone forms a concave conical seating surface 107 corresponding to the convex seating surface 32 of the crossover sub 27 at the top of the housing 11. The conical seating surface 107 serves as a guide for receiving the female element 108 of the wet connector and forms a metal to metal seal with the convex surface 32 when the piston 70 acts as a through pipe blowout preventer (described hereinafter).

Figure 3:
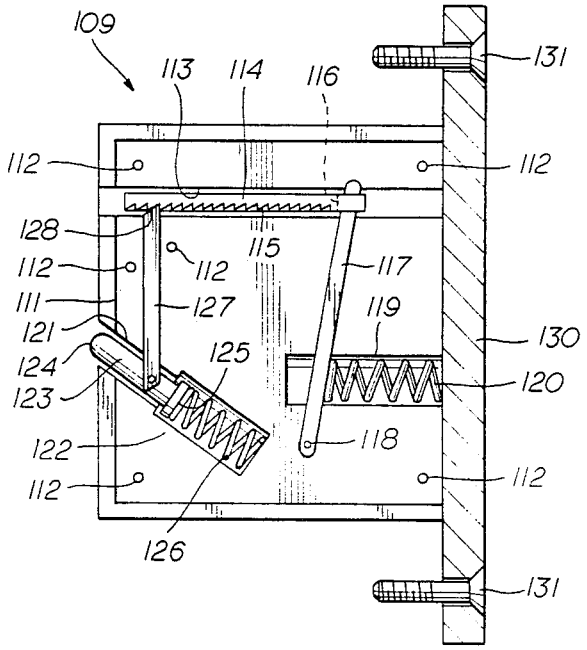
FIG. 3 is an enlarged cross section of the wet connect latch assembly of the tool.

A set connect latch assembly 109 is secured within an aperture 110 through the side wall of the upper portion of the guide cone 104. The latch assembly 109 is shown in greater detail in FIG. 3. The latch assembly 109 comprises a split housing 111 divided into two generally recessed mating halves and joined by transverse pins 112.

Each half of the housing 111 has an upper horizontal slot 113 which slidably receives an elongated shear pin 114 having notches 115 on the bottom surface. The rear end of the shear pin 114 has a vertical slot 116 perpendicular to the notched bottom. The slot 116 receives the upper end of a drive arm 117, the lower end of which is pivotally connected to the housing 111 by pivot pin 118.

A horizontal bore 119 extends inwardly from one side of the housing 111 just above the pivot pin 118. A compression spring 120 is received within the bore 119 to bias the drive arm 117, and push the shear pin 114 toward the central bore of the piston body.

An angular bore 121 and counterbore 122 extend downwardly from the inward side of the housing 111. A cylindrical latch member 123 having a rounded top surface 124 is slidably received within the angular bore 121. The latch member 123 has a disc shaped back end 125 which is slidably received within the counterbore 122. A compression spring 126 is received within the lower counterbore 122 in contact with the disc shaped back end 125 of the latch member 123.

A rod member 127 having a slotted bottom is pivotally connected to the latch member 123 and extends generally vertical therefrom between two pins 112. The top end of the rod 127 is beveled 128 corresponding to the notches 115 of the shear pin 114 to be received therein for retaining the shear pin against outward movement. In this manner, as the latch member 123 moves angularly inward and outward, the rod 127 will move vertically to engage or disengage the notches of the shear pin 114.

A backing plate 130 is installed at the back end of the housing 111 and secured by screws 131 to the outer surface of the guide cone 104 to cover outer side of the housing 111 and retain the spring 120 within the bore 119.

In operation, the bottom of the wet connect cable transport assembly 132 (FIG. 4) entering the central bore 72 of the piston body 71 will force the latch member 123 inwardly pulling the rod 127 down and release the shear pin 114 to be driven outwardly by the drive arm 117 and be received in the latching groove 135 on the female connector element 108.

Figure 4:
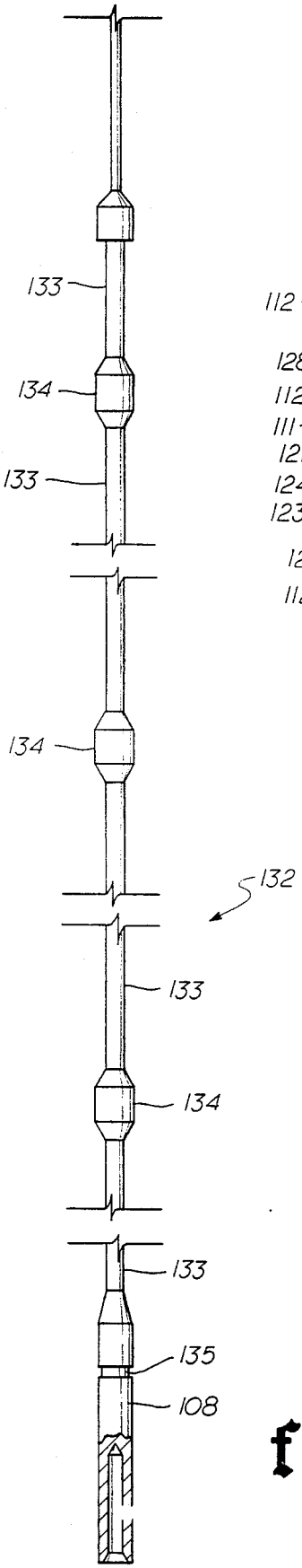
FIG. 4 is a schematic elevation of a wet connect cable transport assembly used with the tool.

A locomotive or wet connect cable transport assembly 132 is shown schematically in FIG. 4. The assembly is conventional in the art and comprises a series of connected tubing joints 133 having drive cups 134 installed in a spaced relation along its length. It should be understood that at least one upper drive cup must remain in the drill pipe 35 for effective connection of the wet connector elements 101 and 108.

The internal diameter of the assembly 132 is sufficient to allow passage of cable and rope sockets therethrough (also conventional in the art). The female element 108 of the wet connector is carried at the bottom of the assembly 132. A latching groove 135 is provided on the circumference of the female element 108. The latching groove 135 is located such that the shear pin 114 will be received therein when the female element 108 is properly connected with the male element 101 of the wet connector within the bore 71 of piston 70.

Figure 5:
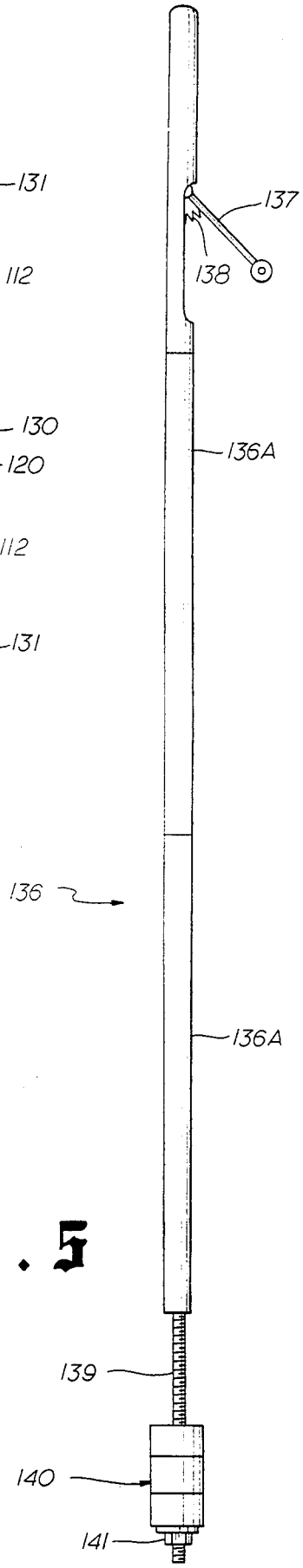
FIG. 5 is a schematic elevation of a visual float assembly used with the tool.

FIG. 5 illustrates a visual float indicator 136. The indicator 136 comprises two sections of tubing 136A threadedly connected with appropriate seals and sealed at each end to form an elongated bouyant tubular member approximately 20 feet in length. A detent 137 is pivotally connected near the top of the float assembly 136 and biased by a compression spring 138 to extend outward. A threaded rod 139 is secured to the bottom of the lowermost tubing joint and receives a number of weights 140 to selectively adjust the bouyancy of the assembly. A lock nut 141 retains the weights 140 on the rod 139.

The float indicator 136 floats in the drilling mud within the uppermost section of drill pipe 35 at the surface of the rig floor and visually indicates that the piston 70 is displacing drilling mud before any mud is spilled on the rig floor. Detent 137 will be biased outward by the spring 138 if the float 136 is displaced above the drill pipe 35. The outwardly extended detent 137 also aids in removal of the float 136 for pump installation. It should be understood that the float indicator may be operatively connected to various alarm devices.

Figure 8:
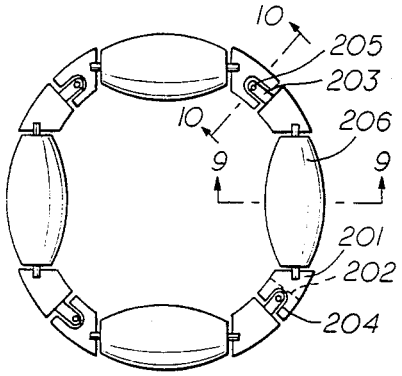
FIGS. 8, 9, and 10 illustrate an alternate expansible cylindrical ring which surrounds the reduced diameter portion of the piston body.
Figure 9:
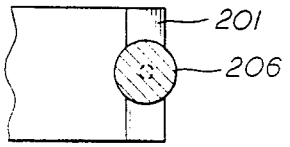
Figure 10:
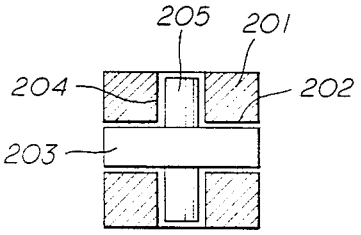

FIGS. 8, 9, and 10 illustrate an alternate expansible cylindrical ring 200 which surrounds the reduced diameter portion 78 of the piston body 71 and abuts the compression spring 81. The expansible ring 200 is divided into cylindrical segments 201, each having an inwardly extending horizontal slot 202 at one and a flat mating tongue 203 at the other end. The tongue 203 of one segment is slidably received within the slot 202 of the adjacent segment. A second guide slot 204 perpendicular to the horizontal slot 202 extends angularly inward from the slotted end of each segment. Pins 205 extend vertically through each tongue 203 and are slidably received within the guide slots 204.

An oval-shaped roller member 206 is rotatably pinned within each segment 202 such that the outer circumference extends outwardly of the inside and outside diameters of the segments. The rollers 206 rotate and the segments 201 travel radially inward and outward following the profile of the camming surface 78A and groove 80 as the ring 82 travels along the longitudinal axis of the piston body 71.

The compression spring 81 is of sufficient strength to require 2,500 pounds of force to move the piston from the latched position with the roller members 206 in the groove 44 of the latch collar 41 to the unlatched position with the roller members retracted into the groove 80 of the piston 70.

Figure 11:
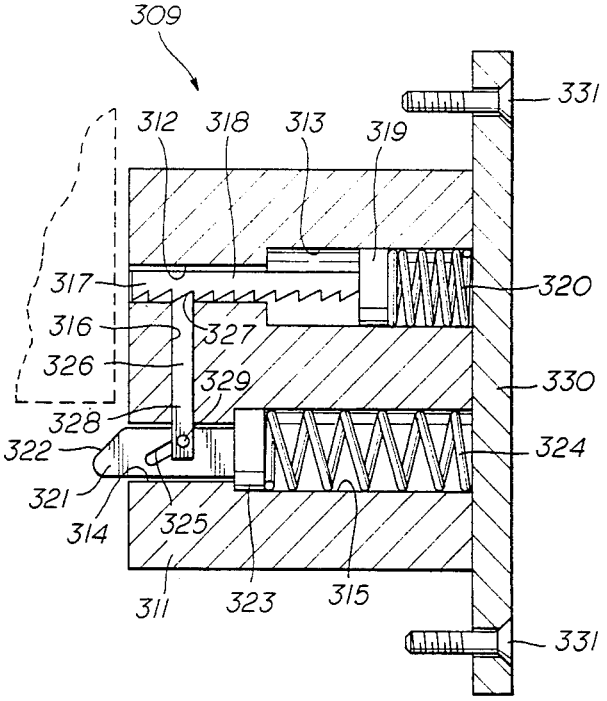
FIG. 11 is a vertical cross section of an alternate wet connect latch mechanism.

FIG. 11 is a vertical cross sectional view of an alternate wet connect latch mechanism 309. The wet connect latch assembly 309 is secured within an aperture 110 through the side wall of the upper portion of the guide cone 104. The latch assembly 309 comprises a housing 311 having an upper horizontal bore 312 and counterbore 313, and a vertically spaced lower horizontal bore 314 and counterbore 315 extending therethrough. A vertical bore 316 extends between the bores 312 and 314. An elongated shear pin 317 having a series of notches 318 along the lower side is slidably received within the upper bore 312 and counterbore 313. A flat circular disc 319 is slidably received within the upper counterbore 313 in contact with the inward end of the shear pin 317. A compression spring 320 is received within the upper counterbore 313 in contact with the disc 319.

A cylindrical latch member 321 having an upwardly facing beveled top surface 322 is slidably received within the lower bore 314. The latch member 321 has a disc shaped back end 323 which is slidably received within the lower counterbore 315. A compression spring 324 is received within the lower counterbore 315 in contact with the disc shaped back end 323 of the latch member 321.

A longitudinal slot 325 extends transversely through the latch member 321. The slot 325 extends angularly upward relative to the longitudinal axis of the latch member 321 from a point near its front end and terminates near the disc shaped back end 323. A rod member 326 having a notched top end 327 corresponding to the notches 318 of the shear pin 317 and a yoke shaped bottom end 328 is received within the vertical bore 316 and attached by pin 329 to the slot 325 of the latch member 321. In this manner, as the latch member 321 moves horizontally, the rod 326 will move vertically to engage or disengage the notches 318 and 327.

A backing plate 330 is installed at the back end of the housing 311 and secured by screws 331 to the outer surface of the guide cone 304 to cover the counterbores 313 and 315 and retain the springs 320 and 324 therein.

OPERATION

The continuous obstruction monitor (hereinafter referred to as "COM") is assembled in two sections for ease in raising to the rig floor. The bottom section is set in slips and connected to the upper section. The complete assembly is raised up and out of the way. The piston 70 is contained within the transport sleeve 47 supported by the retaining ring 53 at the bottom of the outer housing with the wet connect housing 85 extending outwardly therefrom. In the transport position, the circulation ports 77 of the piston 70 are adjacent the apertures 52 of the transport sleeve 47, and the ball members 84 are retained in the annular groove 44 of the latch collar 41 by the piston camming surface 78*a*.

The conventional well logging tool 87 is assembled and suspended over the borehole on the make-up plate. The lower end of the wet connect housing 85 is connected to the upper end of the logging tool 87.

Verification is made that the borehole is full of drilling mud and that drilling mud is not being lost in the formation. It is essential that the borehole be full of drilling mud for proper operation of the COM and the prevention of blowouts.

The assembled logging tool 85 and COM assembly 10 is lowered into the borehole and the lowermost drill pipe 35 is connected to the crossover sub 27 at the top of the COM assembly.

With the top of the drill pipe at the rig floor, the visual float indicator 136 (FIG. 5) is inserted thereinto and the bouyancy of the float indicator properly adjusted by addition or subtraction of weights 140 so that the top of the float indicator is just below the rig floor. The float indicator may be removed, if desired, by filling the pipe with water.

The assembly is again lowered down the borehole. At this point, the float indicator 136 is continuously observed. If an obstruction is encountered by the logging tool 85, the indicator 136 will protrude out of the top of the drill pipe. Continued downward movement after an obstruction is encountered will cause drilling mud to be displaced out of the top of the drill pipe. If an obstruction is indicated by the float indicator, detent 137 on the side of the indicator will spring out preventing the float from going back down into the drill pipe.

The drill pipe is raised to the stabbing board and the float indicator is removed. By noting how far the pipe stand was in the borehole when the obstruction was encountered, calculations are made to determine how many drill pipe joints should be removed to install the kelly hose. The kelly hose is installed, and the drill pipe and kelly assembly is lowered into the borehole. Drilling mud displaced by the COM assembly is allowed to flow out through the kelly hose. As the obstruction is once again encountered, the drill pipe is raised slightly, and circulation is begun. Circulation should begin slowly, working through the obstruction.

Once the obstruction has been cleared, the drilling mud flowing past the piston will carry it back down to the transport sleeve at the bottom of the COM assembly. The kelly is removed, and the drill pipe and COM assembly continues to be lowered in the borehole.

The kelly is disconnected and removed, and the COM assembly is brought back up through the borehole in the logging mode as logging operations are performed in the conventional manner. If stops are desired, the COM allows circulation and pipe movement within the transport sleeve. In the event of a blowout, the COM piston will be blown to the top of the housing to seal on the conical bottom of the crossover sub.

Referring now to FIGS. 1*a*–1*c* and 6, the movement of the piston 70 within the outer housing 11 of the COM assembly 10 will be explained. As shown schematically in FIG. 6, the outer housing 11 may be divided into several longitudinally spaced sections. The lowermost section T extends from the retaining ring 53 to the top of the latch collar 41 and represents the transport mode. In this position, the piston 70 is supported at the bottom of the transport sleeve 47 while being transported down the borehole.

The D section represents the detection mode and extends upwardly from the top of the latch collar 41 to the bottom of the lowermost bypass sleeve 12, and includes the series of sealing sleeves 36. The piston 70 moves up into this area when the logging tool 87 encounters an obstruction. It should be remembered that an upward force of 2,500 pounds is required for the piston to pass through the latch, and only a very slight force to pass downwardly through the latch. The piston seal assembly 88 seals on the internal surfaces of the sealing sleeves 36 displacing drilling mud at the top of the drill pipe 35 to raise the visual float indicator 136.

The B section represents the bypass mode and extends upwardly from the top of the uppermost sealing sleeve 36 to the bottom of the blowout prevention sleeve 22, and includes the series of bypass sleeves 12. The piston 70 moves up into this area after the logging tool 87 has encountered an obstruction. The longitudinal slots 16 on the internal diameter of the bypass sleeves 12 permits drilling mud to bypass the piston and allow circulation to the bottom of the outer housing for clearing the obstruction.

The S section represents the safety or blowout prevention mode and extends from the top of the uppermost bypass sleeve 12 to the bottom of the crossover sub 27, and includes the blowout prevention sleeve 22. The piston 70 moves up into this area when the borehole pressure exceeds the weight of the fluid column. The concave top surface 107 of the piston 70 will seal on the convex conical bottom surface 32 of the crossover sub 27 and prevent a through pipe blowout.

Referring now to FIGS. 1*a*–1*c* and 7, the housing may be modified by removing a slotted bypass sleeve 12 from the upper assembly and adding one below the lowermost sealing sleeve 36 and compensating for the increased length by the addition of the modified retaining ring 58 and casing 67 below the transport sleeve 47. This modification allows tranporting and setting of the logging tool, circulation through the housing, and reciprocation of the drill pipe, all within the confines of the retaining ring 53 and the latch collar 41. This mode of operation, represented by R, is referred to as the reciprocation mode.

Having illustrated a preferred embodiment of the apparatus wherein the outer housing is connected to the drill string and the piston to the logging instrument, it should be understood that the outer housing could be connected to the logging instrument and the piston connected to the drill string without departing from the scope of the invention.

While this invention has been described fully and completely with special emphasis upon a preferred embodiment, it should be understood that within the scope of the appended claims the invention may be practiced otherwise than as specifically described herein.

I claim:

1. Apparatus for continuously monitoring a borehole for obstruction during well logging, comprising an elongate tubular outer housing having means at the upper end for connection to a drill string, a movable inner member slidably supported inside said outer housing, said inner member having means for connection to support a well logging instrument, a releasable means retaining said inner member initially in the lower portion of said housing and to release said inner member upon a predetermined upward force thereon, said outer housing and inner member having relative movement upon contact of said logging instrument with an obstruction within said borehole with sufficient force to release said inner member from said releasable means thereby causing displacement of a column of drilling fluid within said housing and said drill string for detection at the earth surface, and means movable in response to said drilling fluid displacement and having a portion visible at the earth surface to indicate an obstruction.

2. Apparatus according to claim 1 in which said outer housing has a variable volume greater than the volume of an equal length of the drill string used to transport the same through said borehole, and means establishing a fluid flow path through said drill string to exit the lower portion of said housing to circulate drilling fluid in close proximity of the borehole obstruction on continued relative movement of said outer housing and said inner member beyond said movement releasing said releasable means.

3. Apparatus according to claim 1 in which said inner member comprises a piston reciprocally movable in said outer housing, and said releasable means comprises a spring-loaded detent releasable on application of a predetermined force.

4. Apparatus according to claim 1 in which said outer housing has a lower portion with interior annular fluid flow passages and apertures through the side wall for flow of drilling fluid from the housing interior to the borehole, a mid portion spaced thereabove with a smooth interior sealing surface, and an upper portion with interior annular fluid flow passages, and said inner member having a circumferential seal, a central fluid passage extending inwardly a distance from the upper end, and apertures through the side wall above said seal open to said central fluid passage for flow of drilling fluid from inside said inner member to the annulus between said inner member and outer housing side wall and through the apertures in said outer housing when said inner member is in the lowermost position, said outer housing being movable downward relative to said inner member upon contact of said logging instrument with an obstruction in said borehole with sufficient force to release said inner member from said releasable means to move to a position within said sealing surface of said housing mid portion shutting off fluid flow below said inner member circumferential seal and causing displacement of a column of drilling fluid within said housing and said drill string above said circumferential seal sufficient to be detected at the earth surface, and continued downward movement of said housing relative to said inner member causing said inner member to enter said upper portion of said housing to establish a fluid flow path through said drill string and bypassing said inner member circumferential seal through said annular fluid flow passages of said side wall and exit said housing lower portion apertures to circulate drilling fluid in close proximity of the borehole obstruction.

5. The apparatus according to claim 4 in which said outer housing upper portion has a smooth internal sealing surface having interior annular fluid flow passages, the top portion thereof being reduced in diameter defining a convex downwardly facing shoulder, the top surface of said inner member includes a concave upwardly facing shoulder, said inner member circumferential seal forming an annular fluid seal on said interior surface, and said inner member concave shoulder being received in sealing contact on said convex shoulder in the uppermost position of said inner member to prevent pressure and drilling fluid from below said circumferential seal from entering the interior of said drilling string.

6. The apparatus according to claim 4 including said obstruction indicator means being positioned within the uppermost drill string section connected to said outer housing and cooperative with a column of drilling fluid therein to produce a signal upon displacement of drilling fluid by said inner member.

7. The apparatus according to claim 6 in which said indicator comprises;

separable tubular members connected and sealed to form an elongated bouyant tubular float, a spring-biased detent pivotally mounted near the top of the float, a threaded rod secured to the bottom of the float to receive a number of weights for selectively adjusting the bouyancy of the float and a removable lock nut for installing and retaining the weights thereon, a plurality of weight members adapted to be received and secured on said rod, said float being removably and bouyantly supported on a column of drilling fluid within the uppermost section of said drill string at the surface of the rig floor to visually indicate upon upward movement that said inner member is displacing drilling mud before any fluid is spilled on the rig floor, and said detent biased outward of the uppermost section of said drill string upon being raised above the top surface thereof for assistance in removal of said float.

8. The apparatus according to claim 4 including a logging cable transport assembly having a logging cable at least a portion of which is enclosed within an elongate tubular protective housing capable of passing through said drill string and the lower end of which is adapted to be received and secured within said inner member, said cable being connected at its upper end to data recording equipment at the earth surface and at its lower end to one element of said electrical connector, and drive cups secured longitudinally along the length of said protective housing, said cups adapted to be slidably received within said drill string and moved therethrough by drilling fluid pumped thereinto from the earth surface to transport said mating element into said piston sufficient to complete a positive electrical connection with said one element within said inner member, and at least one of said cups operatively disposed within said drill string during the pumping operation.

9. The apparatus according to claim 4 in which said outer housing includes means at its lower end for connection of additional tubular members to extend the length thereof.

10. The apparatus according to claim 4 in which said outer housing upper portion comprises;

a plurality of bypass sleeves, each having external threads at each end, a circumferential groove disposed inwardly of said threads, and annular seals on the exterior surface at each end intermediate the threads and grooves for sealing the threads after connection, and a plurality of circumferentially spaced longitudinal slots on the interior surface of the side wall thereof, said bypass sleeves being threadedly connected together at each end by collars with internal threads at each end and a central reduced internal diameter forming a shoulder and having a plurality of longitudinal slots corresponding to the slots in said sleeve, and said collars being threadedly tightened on said bypass sleeves with said side wall slots in alignment with said shoulder slots and locked onto said sleeves by set screws fitting within said sleeve grooves.

11. The apparatus according to claim 10 in which said outer housing upper portion includes a blowout prevention sleeve of tubular construction connected and secured by one of said collars and set screws at its lower end to the uppermost said bypass sleeve, said blowout prevention sleeve having a smooth central bore, external threads at each end, an external circumferential groove inwardly of the threads, and annular seals at each end intermediate the threads and grooves sealing the threads after connection, and a crossover sub having an externally threaded lower portion and annular seal thereabove connected and secured onto the upper portion of said blowout prevention sleeve by another of said collars by set screws, the upper portion of said crossover sub being provided with internal threads extending inwardly from the top to a reduced diameter bore, and the bottom surface of said sub being tapered inwardly downward forming a convex conical sealing surface, and said internal threads adapted to receive the lower end of said drill string.

12. The apparatus according to claim 10 in which said outer housing mid portion comprises;

a plurality of tubular sealing sleeves, each having external threads at each end, a circumferential groove disposed inwardly of the threads, and annular seals at each end intermediate the threads and grooves for sealing the threads after connection, and a smooth central bore, and the uppermost sleeve being connected to the lowermost bypass sleeve and said sealing sleeves being threadedly connected together at each end by said collars and set screws.

13. The apparatus according to claim 10 in which said outer housing lower portion comprises;

a cylindrical latch collar disposed beneath the lowermost sealing sleeve with internal threads at each end, a reduced diameter bore defining a shoulder immediately below the top internal threads, an internal annular groove immediately below the shoulder, and a plurality of circumferentially spaced longitudinal internal slots below the annular groove and in said shoulder, a tubular transport sleeve beneath said latch collar with external threads at each end, an exterior circumferential groove inwardly of the threads, and annular seals at each end intermediate the threads and grooves for sealing the threads after connection, a plurality of circumferentially spaced longitudinal slots on the interior surface of said transport sleeve, and a plurality of circumferentially spaced apertures extending through the side wall of the said sleeve for flow of drilling fluid from said sleeve into the borehole, said inner member being reciprocally contained within said tranport sleeve, a cylindrical retaining ring having internal threads connected to the bottom of said transport sleeve, said threads extending inwardly from the top to a reduced diameter bore to define an inwardly and downwardly tapered shoulder supporting said inner member, and said latch collar being connected and secured at its upper end to the bottom of the lowermost sealing sleeve by set screws and said transport sleeve connected and secured at its upper end to the bottom of said latch collar by set screws.

14. The apparatus according to claim 13 in which the exterior bottom portion of said retaining ring has an annular seal and exterior threads, and said outer housing lower portion includes a cylindrical crossover adapter collar received and secured on said exterior threads, said adapter collar having an internally threaded bottom portion for connection of additional tubular members beneath the transport sleeve.

15. The apparatus according to claim 13 in which said inner member comprises a piston having a cylindrical body with a central bore and internal threads in the upper portion defining a shoulder therebetween, said logging instrument being operatively connected within the bottom portion thereof, circulation ports extending from the exterior of the piston body to the central bore above said connective means for flow of drilling mud from within the piston to the exterior, a reduced diameter portion on the exterior of the piston body defining a circumferential shoulder above the circulating ports and a circumferential groove on the reduced diameter near the upper end defining a raised camming surface above the groove, a compression spring received on the shoulder and surrounding the reduced diameter portion, said releasable means for retaining said piston movably supported on the top of said compression spring and cooperative with said camming surface and said latch collar groove, said compression spring of sufficient strength to require a predetermined upward force on the piston body to move the piston releasable means from the latched position within said latch collar groove to the unlatched position released from said piston groove, and said piston circumferential seal surrounding the lower portion of said logging instrument connective means.

16. The apparatus according to claim 15 in which said releasable means for retaining said piston within said housing lower portion comprises a cylindrical ring supported on the top of said compression spring with a plurality of circumferentially spaced tapered apertures extending through the side wall thereof, and a series of ball members movably contained within said apertures captured between the circumference of the camming surface and the internal diameter of the ring, the diameter of the ball members being greater than the longitudinal slots of said latch collar such that they are prevented from entering the slots, said tapered apertures preventing said ball members from falling out of said ring while allowing them to rotate and travel radially inward and outward following the profile of said camming surface and said groove as said ring travels along the longitudinal axis of said piston body.

17. The apparatus according to claim 15 in which said logging instrument connecting means comprises a tubular electrical connector adapter housing received and secured within a counterbore in the lower portion of said piston body below said circulation ports, the lower portion of said adapter housing extending outwardly from said piston body and the distal end provided with connecting means for connection to the top portion of a well logging instrument, said lower portion of said adapter housing of sufficient diameter to freely pass through the bore of the retaining ring upon movement of said logging instrument.

18. The apparatus according to claim 17 in which said logging instrument connective means includes one element of an electric connector secured within said adapter housing and having the connecting portion protruding upwardly a distance from the top of said housing centrally within said piston bore, the bottom of said element connected by wire leads to the logging instrument, said piston having an inwardly and angularly downwardly tapered top surface for guidedly receiving the mating element of said electric connector and forming a concave conical seating surface corresponding to the convex seating surface said crossover sub at the top of said outer housing, and said latch means carried by said piston for receiving and releasably securing the mating element of the electrical connector to said one element disposed within the upper portion of said piston and activated upon receipt of said mating element and connection of same to said one element to releasably secure said elements in the connected position.

19. The apparatus according to claim 18 in which said electrical connector latch assembly comprises a housing having an upper horizontal bore and counterbore, a vertically spaced lower horizontal bore and counterbore extending therethrough, a vertical bore extending between said horizontal bores, an elongated shear pin having a series of notches along the lower side slidably received within said upper bore and counterbore, a flat circular disc slidably received within said upper counterbore in contact with the inward end of said shear pin, a compression spring received within said upper counterbore in contact with said disc, a cylindrical latch member having an upwardly facing beveled top surface slidably received within said lower bore, said latch member having a disc shaped back end slidably received within said lower counterbore, a compression spring received within the lower counterbore in contact with said disc shaped back end of said latch member, a longitudinal slot extending transversely through said latch member angularly upward relative to the longitudinal axis of said latch member from a point near its front end and terminating near the disc shaped back end, a rod member having a notched top end corresponding to the notches of the shear pin and a yoke shaped bottom end received within the vertical bore and attached by a pin to the slot of the latch member such that as the latch member moves horizontally, the rod will move vertically to engage or disengage said notches, and a backing plate installed at the back end of the latch assembly housing and secured to the outer surface of the piston body to cover said counterbores and retain said springs therein.

20. The apparatus according to claim 15 in which said piston circumferential seal is an assembly comprising a plurality of resilient seal members interposed between a series of thin spacer discs, a bottom spacer disc at the bottom of the lowermost seal member, a thrust bearing below the spacer disc, a thin retaining disc below the spacer disc, a retaining plate below the retaining disc carrying a rotary bearing within a counterbore at its upper end, the bottom surface of the retaining plate beveled at an angle corresponding to the said tapered shoulder of said retaining ring to be supported thereon, and a cylindrical stop plate installed below the retaining plate and secured to limit downward travel of said seal assembly and retaining plate, the bottom surface of said stop plate beveled at an angle corresponding to the said beveled shoulder of said retaining ring to be supported thereon.

21. Apparatus according to claim 15 in which said releasable means for retaining said piston within said housing lower portion comprises a cylindrical ring supported on the top of said compression spring with a plurality of circumferentially spaced tapered apertures extending through the side wall thereof, and a series of ball members movably contained within said apertures captured between the circumference of the camming surface and the internal diameter of the ring, the diameter of the ball members being greater than the longitudinal slots of said latch collar such that they are prevented from entering the slots, said tapered apertures preventing said ball members from falling out of said ring while allowing them to rotate and travel radially inward and outward following the profile of said camming surface and said groove as said ring travels along the longitudinal axis of said piston body.

22. Apparatus according to claim 1 including electric connector means comprising a two-part, male-female connector, one part of said electric connector means being supported in said inner member and operatively coupled to said logging instrument, the other part of said connector being secured on the lower end of the drill string, and latch means on said inner member for releasably securing said other connector part to said one part.

23. A well logging drill string system including a well logging instrument at the forward end and apparatus disposed therebetween for continuously monitoring for obstructions within in an earth borehole while passing the logging instrument therethrough, said apparatus comprising;

an elongate tubular outer housing having means at the upper end connected to said drill string, a movable inner member slidably supported inside said outer housing, said inner member having connected to support said well logging instrument, releasable means retaining said inner member initially in the lower portion of said housing and to release said inner member upon a predetermined upward force thereon, said outer housing and inner member having relative movement upon contact of said logging instrument with an obstruction within said borehole with sufficient force to release said inner member from said releasable means thereby causing displacement of a column of drilling fluid within said housing and said drill string for detection at the earth surface, and means movable in response to said drilling fluid displacement and having a portion visible at the earth surface to indicate an obstruction.

24. Apparatus according to claim 23 in which said outer housing has a variable volume greater than the volume of an equal length of said drill string used to transport it through said borehole, and means establishing a fluid flow path through said drill string to exit the lower portion of said housing to circulate drilling fluid in close proximity of the borehole obstruction on continued relative movement of said outer housing and said inner member beyond said movement releasing said releasable means.

25. Apparatus according to claim 23 in which said inner member comprises a piston reciprocally movable in said outer housing, and said releasable means comprises a spring-loaded detent releasable on application of a predetermined force.

26. Apparatus according to claim 23 in which said outer housing has a lower portion with interior annular fluid flow passages and apertures through the side wall for flow of drilling fluid from the housing interior to the borehole, a mid portion spaced thereabove with a smooth interior sealing surface, and an upper portion with interior annular fluid flow passages, and said inner member having a circumferential seal, a central fluid passage extending inwardly a distance from the upper end, and apertures through the side wall above said seal open to said central fluid passage for flow of drilling fluid from inside said inner member to the annulus between said inner member and outer housing side wall and through the apertures in said outer housing when said inner member is in the lowermost position, said outer housing being movable downward relative to said inner member upon contact of said logging instrument with an obstruction in said borehole with sufficient force to release said inner member from said releasable means to move to a position within said sealing surface of said housing mid portion shutting off fluid flow below said inner member circumferential seal and causing displacement of a column of drilling fluid within said housing and said drill string above said circumferential seal sufficient to be detected at the earth surface, and continued downward movement of said housing relative to said inner member causing said inner member to enter said upper portion of said housing to establish a fluid flow path through said drill string and bypassing said inner member circumferential seal through said annular fluid flow passages of said side wall and exit said housing lower portion apertures to circulate drilling fluid in close proximity of the borehole obstruction.

27. Apparatus according to claim 26 in which said outer housing upper portion has a smooth internal sealing surface having interior annular fluid flow passages, the top portion thereof being reduced in diameter defining a convex downwardly facing shoulder, the top surface of said inner member includes a concave upwardly facing shoulder, said inner member circumferential seal forming an annular fluid seal on said interior surface, and said inner member concave shoulder being received in sealing contact on said convex shoulder in the uppermost position of said inner member to prevent pressure and drilling fluid from below said circumferential seal from entering the interior of said drill string.

28. The apparatus according to claim 26 including said obstruction indicator means being positioned within the uppermost drill string section connected to said outer housing and cooperative with a column of drilling fluid therein to produce a signal upon displacement of drilling fluid by said inner member.

29. The apparatus according to claim 28 in which said indicator comprises;

separable tubular members connected and sealed to form an elongated bouyant tubular float, a spring-biased detent pivotally mounted near the top of the float, a threaded rod secured to the bottom of the float to receive a number of weights for selectively adjusting the bouyancy of the float and a removable lock nut for installing and retaining the weights thereon, a plurality of weight members adapted to be received and secured on said rod, said float being removably and bouyantly supported on a column of drilling fluid within the uppermost section of said drill string at the surface of the rig floor to visually indicate upon upward movement that said inner member is displacing drilling mud before any fluid is spilled on the rig floor, and said detent biased outward of the uppermost section of said drill string upon being raised above the top surface thereof for assistance in removal of said float.

30. The apparatus according to claim 26 including a logging cable transport assembly having a logging cable at least a portion of which is enclosed within an elongate tubular protective housing capable of passing through said drill string and the lower end of which is adapted to be received and secured within said inner member, said cable being connected at its upper end to data recording equipment at the earth surface and at its lower end to one element of said electrical connector, and drive cups secured longitudinally along the length of said protective housing, said cups adapted to be slidably received within said drill string and moved therethrough by drilling fluid pumped thereinto from the earth surface to transport said mating element into said piston sufficient to complete a positive electrical connection with said one element within said inner member, and at least one of said cups operatively disposed within said drill string during the pumping operation.

31. Apparatus according to claim 26 in which said outer housing includes means at its lower end for connection of additional tubular members to extend the length thereof.

32. Apparatus according to claim 26 in which said outer housing upper portion comprises;

a plurality of bypass sleeves, each having external threads at each end, a circumferential groove disposed inwardly of said threads, and annular seals on the exterior surface at each end intermediate the threads and grooves for sealing the threads after connection, and a plurality of circumferentially spaced longitudinal slots on the interior surface of the side wall thereof, said bypass sleeves being threadedly connected together at each end by collars with internal threads at each end and a central reduced internal diameter forming a shoulder and having a plurality of longitudinal slots corresponding to the slots in said sleeve, and said collars being threadedly tightened on said bypass sleeves with said side wall slots in alignment with said shoulder slots and locked onto said sleeves by set screws fitting within said sleeve grooves.

33. Apparatus according to claim 32 in which said outer housing upper portion includes a blowout prevention sleeve of tubular construction connected and secured by one of said collars and set screws at its lower end to the uppermost said bypass sleeve, said blowout prevention sleeve having a smooth central bore, external threads at each end, an external circumferential groove inwardly of the threads, and annular seals at each end intermediate the threads and grooves sealing the threads after connection, and a crossover sub having an externally threaded lower portion and annular seal thereabove connected and secured onto the upper portion of said blowout prevention sleeve by another of said collars by set screws, the upper portion of said crossover sub being provided with internal threads extending inwardly from the top to a reduced diameter bore, and the bottom surface of said sub being tapered inwardly downward forming a convex conical sealing surface, and said internal threads adapted to receive the lower end of said drill string.

34. Apparatus according to claim 32 in which said outer housing mid portion comprises;

a plurality of tubular sealing sleeves, each having external threads at each end, a circumferential groove disposed inwardly of the threads, and annular seals at each end intermediate the threads and grooves for sealing the threads after connection, and a smooth central bore, and the uppermost sleeve being connected to the lowermost bypass sleeve and said sealing sleeves being threadedly connected together at each end by said collars and set screws.

35. Apparatus according to claim 32 in which said outer housing lower portion comprises;

a cylindrical latch collar disposed beneath the lowermost sealing sleeve with internal threads at each end, a reduced diameter bore defining a shoulder immediately below the top internal threads, an internal annular groove immediately below the shoulder, and a plurality of circumferentially spaced longitudinal internal slots below the annular groove and in said shoulder, a tubular transport sleeve beneath said latch collar with external threads at each end, an exterior circumferential groove inwardly of the threads, and annular seals at each end intermediate the threads and grooves for sealing the threads after connection, a plurality of circumferentially spaced longitudinal slots on the interior surface of said transport sleeve, and a plurality of circumferentially spaced apertures extending through the side wall of the said sleeve for flow of drilling fluid from said sleeve into the borehole, said inner member being reciprocally contained within said transport sleeve, a cylindrical retaining ring having internal threads connected to the bottom of said transport sleeve, said threads extending inwardly from the top to a reduced diameter bore to define an inwardly and downwardly tapered shoulder supporting said inner member, and said latch collar being connected and secured at its upper end to the bottom of the lowermost sealing sleeve by set screws and said transport sleeve connected and secured at its upper end to the bottom of said latch collar by set screws.

36. Apparatus according to claim 35 in which the exterior bottom portion of said retaining ring has an annular seal and exterior threads, and said outer housing lower portion includes a cylindrical crossover adapter collar received and secured on said exterior threads, said adapter collar having an internally threaded bottom portion for connection of additional tubular members beneath the transport sleeve.

37. Apparatus according to claim 35 in which said inner member comprises a piston having a cylindrical body with a central bore and internal threads in the upper portion defining a shoulder therebetween, said logging instrument being operatively connected within the bottom portion thereof, circulation ports extending from the exterior of the piston body to the central bore above said connective means for flow of drilling mud from within the piston to the exterior, a reduced diameter portion on the exterior of the piston body defining a circumferential shoulder above the circulating ports and a circumferential groove on the reduced diameter near the upper end defining a raised camming surface above the groove, a compression spring received on the shoulder and surrounding the reduced diameter portion, said releasable means for retaining said piston being supported on top of said compression spring and cooperative with said camming surface and latch collar groove, said compression spring of sufficient strength to require a predetermined upward force on the piston body to move the piston releasable means from the latched position within said latch collar groove to the unlatched position released from said piston groove, and said piston circumferential seal surrounding the lower portion of said logging instrument connective means.

38. Apparatus according to claim 23 including electric connector means comprising a two-part, male-female connector, one part of said electric connector means being supported in said inner member and operatively coupled to said logging instrument, the other part of said connector being secured on the lower end of the drill string, and latch means on said inner member for releasably securing said other part of the electric connector to said one part.

39. A method of continuously monitoring for obstructions within an earth borehole filled with a drilling fluid while passing a well logging instrument therethrough by a drill string comprising the steps of;

installing an elongate tubular outer housing member to the lower end of a drill string to be transported thereby, said outer housing having a variable volume greater than the volume of an equal length of the drill string transporting it, enclosing and releasably retaining a movable inner member in said housing and connecting the lower end of said inner member to the upper portion of a well logging instrument, said inner member releasable to move relative to said outer housing upon the logging instrument contacting an obstruction in the borehole, connecting the logging instrument to equipment at the surface of the borehole for logging operations, verifying that the borehole is filled with drilling fluid, lowering the drill string, having the housing installed on its lower end and the logging instrument installed on the movable inner member, into the borehole, and allowing drilling fluid to enter the drill string from the borehole as it is lowered thereinto, installing means responsive to fluid displacement within the drill string to continuously monitor and communicate changes in the level of the fluid within the drill string, and shutting off fluid communication between the drill string and the borehole upon sufficient movement of the inner member relative to the outer housing caused by the logging instrument contacting an obstruction in the borehole, and simultaneously causing the drilling fluid contained within the drill string to rise and be detected by the means responsive to fluid displacement and thereby indicating that the logging tool has encountered an obstruction.

40. The method according to claim 39 including the step of opening a fluid path between the drill string and the borehole upon further movement of the inner member relative to the outer housing caused by the logging instrument contacting an obstruction in the borehole and discharging the drilling fluid contained within the drill string from the outer housing to be circulated in close proximity of the borehole obstruction to aid in removing the obstruction.

41. The method according to claim 40 including the step of shutting off fluid communication between the interior of the drill string and surface of the hole upon sufficient movement of the inner member relative to the outer housing upon predetermined down-hole pressure in the borehole, and simultaneously causing the drilling fluid contained within the drill string to rise and be detected by the means responsive to fluid displacement and thereby indicating that the logging tool has encountered excessive down-hole pressure and preventing a through pipe blowout.

42. The method according to claim 39 including the step of shutting off fluid communication between the interior of the drill string and surface of the hole upon sufficient movement of the inner member relative to the outer housing upon predetermined down-hole pressure in the borehole, and simultaneously causing the drilling fluid contained within the drill string to rise and be detected by the means responsive to fluid displacement and thereby indicating that the logging tool has encountered excessive down-hole pressure and preventing a through pipe blowout.

* * * * *